United States Patent [19]

Berenyi

[11] Patent Number: 4,668,247

[45] Date of Patent: May 26, 1987

[54] HYDROGEN ENERGY RELEASING CATALYST

[75] Inventor: Szilard Berenyi, Northvale, N.J.

[73] Assignee: Fusion Aided Combustion Technology International Corporation, Northvale, N.J.

[21] Appl. No.: 780,090

[22] Filed: Sep. 25, 1985

[51] Int. Cl.[4] ..... C10L 1/18

[52] U.S. Cl. ..... 44/68; 44/66

[58] Field of Search ..... 44/68

[56] References Cited

U.S. PATENT DOCUMENTS

| | | | |
|---|---|---|---|
| 2,560,542 | 7/1951 | Bartleson et al. | 44/68 |
| 2,890,108 | 6/1959 | Toulmin, Jr. | 44/68 |
| 3,078,662 | 2/1963 | Rocchini et al. | 44/68 |
| 3,205,053 | 9/1965 | McCord | 44/68 |

*Primary Examiner*—William R. Dixon, Jr.
*Assistant Examiner*—Ellen M. McAvoy
*Attorney, Agent, or Firm*—Yusuke Takeuchi

[57] ABSTRACT

A hydrogen energy releasing catalyst comprises a liposoluble organometallic lithium and a vehicle or diluent oil. A process for preparing the aforementioned catalyst which comprises dissolving or dispersing a liposoluble organometallic lithium in a vehicle or diluent oil. A method of using the aforementioned catalyst which comprises adding it to a hydrocarbon fuel at a specified catalyst-to-fuel ratio according to the type of fuel and the combustion device used. In the case of a gasoline or diesel internal combustion engine, the mileage increases from 15% to 35%, while in a furnace or boiler, the fuel efficiency increases from 20% to 35%.

6 Claims, 1 Drawing Figure

HYDROGEN ENERGY RELEASING CATALYST

BACKGROUND OF THE INVENTION

1. Field of the Invention

The present invention relates to a composition of matter for harnessing the hydrogen energy of a hydrocarbon fuel, a process for preparing it, and a method of using it.

2. Description of the Prior Art

Lithium stearate is well known as a lubricant or lubricating oil improver.

It has now been discovered that lithium stearate and other liposoluble organometallic lithium compounds can be used for harnessing the hydrogen energy of hydrocarbon fuels.

SUMMARY OF THE INVENTION

One aspect of the present invention concerns a hydrogen energy releasing catalyst which comprises a liposoluble organometallic salt or salts and a vehicle or diluent thereof.

Another aspect of the present invention concerns a process for preparing the aforementioned catalyst which comprises dissolving or dispersing a liposoluble organometallic salt or salts in a vehicle or diluent oil.

Another aspect of the present invention concerns a method of using the aforementioned catalyst which comprises adding it to a hydrocarbon fuel at a specified catalyst-to-fuel ratio according to the types of fuel and the combustion devices used. In the case of a gasoline or diesel internal combustion engine, the mileage increases from 15% to 35%, while in a furnace or boiler, the fuel efficiency increases from 20% to 35%.

DETAILED DESCRIPTION OF THE INVENTION

Figure 1:
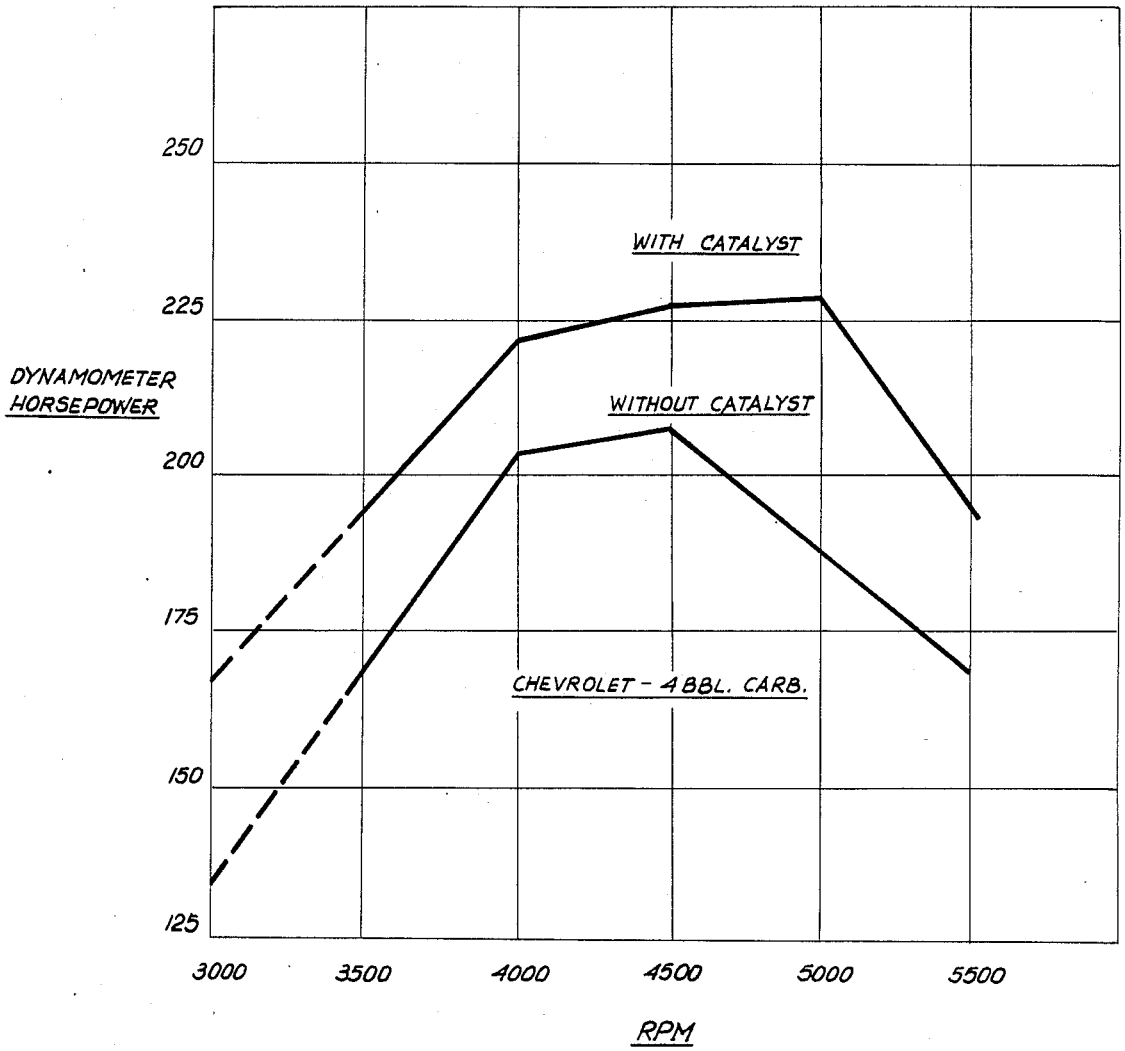
FIG. 1 is a graph showing the relationship between the torque and the number of revolutions of a test engine.

The hydroqen energy releasing catalyst according to the invention comprises from 10% to 90% by weight of at least one liposoluble organometallic salt or salts and from 90% to 10% by weight of a vehicle or diluent thereof.

The liposoluble organometallic salt or salts useful for the present invention are composed of a metallic cation and a carboxylic acid anion. The carboxylic acids for the invention are selected from saturated or unsaturated fatty acids having 2 to 32 carbons, preferably from 15 to 27 carbons, most preferably from 15 to 18 carbons. Examples of such carboxylic acids are stearic, oleic, and palmitic acids. The metallic cation has a valence of 1 to 4. Examples of the preferred metal are sodium, potassium, lithium, magnesium, aluminum, and silicon.

The organometallic lithium is the principal and most active catalytic ingredient capable of harnessing the huge physicochemical energy of the hydrogen atom of a hydrocarbon fuel at temperatures reached by an ordinary combustion engine or furnace. Examples of the preferred organometallic lithium are lithium stearate, lithium oleate, and lithium palmitate.

The organometallic magnesium alone requires very high temperatures and high heat rates to be an active hydrogen energy catalyst. The energy gain by its use alone would be small in an ordinary combustion engine or furnace. However, when the organometallic magnesium is added to the organometallic lithium in the ratio of about 1:2 by weight, there is a greatly improved release of atomic hydrogen. This also results in a decrease in the amount of pollutants in the exhaust gas. Another benefit of its use is improvement in the solubility or dispersibility of the composition in a hydrocarbon fuel.

The organometallic aluminum does not participate in the catalytic reaction of a hydrocarbon fuel. However, when it is mixed with the organometallic lithium and organometallic magnesium in amounts about $\frac{1}{4}$ by weight relative to the amount of organometallic lithium, it increases the pollutant absorbing power and the solubility or miscibility of the composition in the fuel.

Another optional ingredient is an peroxide oxidant or co-catalyst such as lipsoluble benzoyl peroxide or metallic peroxides in amounts from 0.1% to 12%, preferably from 1% to 3% by weight of the composition, to help speed up the interaction of components of the composition for activating them.

The vehicle useful for the invention includes aliphatic, cycloaliphatic, parafinic, olefinic and aromatic hydrocarbons, and other natural, silicon-based, or silicon-substituted synthetic oils, such as castor oil, alkyl glycols, and tetraethylsilane, and mixtures thereof. The amount of a vehicle is from 10% to 90%, preferably from 60% to 80%, by weight of the composition. The preferred aromatic hydrocarbons are of the naphthenic series in amounts preferably from 0.1% to 15%, most preferably about 5% by weight, of the vehicle.

The composition of the invention may be prepared by dispersing or melting and then blending one or more of the afore-mentioned organometallic compounds with one or more of the afore-mentioned vehicle oils. The resultant dispersion or solution is then heat cycled for a specific time at specific temperatures and pressures described below. Finally, it is cooled, and, if desired, other ingredients, such as oxidation promoters, are added.

More specifically, one or more of the organometallic compounds are placed in an autoclave, which is filled with an inert gas, such as helium, and heated at temperatures between 50° and 800° F., preferably between 80° and 495° F., most preferably at about 360°, for melting. Throughout the preparation, the pressure is kept at from one to 30 atm, preferably from one to 10 atm. After the organometallic compounds are melted, the temperature is adjusted to between 250° and 500° F., preferably between 300° and 360° F, and vehicle components are added and the blend held at this temperature for a period of from 5 minutes to 12 hours, preferably from 15 minutes to 6 hours, most preferably about 3 hours. The blend is then subjected to 2 to 10, preferably 5 cycles of optional heat treatment and subsequent cooling cycles of temperatures between 100° and 500°, preferably between 200° and 350°, most preferably between 250° and 300° F., for a period of from 30 minutes to 6 hours, preferably about 2 hours. The blend is finally cooled to room temperature, and any remaining ingredients, such as metallic peroxides, are mixed therewith. The viscosity of the resulting blend is lower when the temperature and pressure used are higher and when the heat cycles are longer.

The composition of the invention may be mixed with a fuel prior to or at the time of combustion in amounts of from 0.0001% to 10%, preferably from 0.005% to 5%, most preferably from 0.05% to 2% by weight of the fuel. In the case of a gasoline or diesel internal combustion engine, the mileage increases from 15% to 35%, while in a furnace or boiler, the fuel efficiency increases from 20% to 35%. The use of the composition in amounts above 10% does not significantly increase the energy harnessing rate. However, it still improves the pollution control and oxygen saving capabilities of the composition.

The mechanism by which the composition of the invention increases the energy harnessing rate is as follows: In high temperature flames the aforementioned organometallic cation produces P-N-P-N or N-P-N-P avalanche reactions releasing high energy ultraviolet radiation and electrons accelerated to high kinetic energy states. The high energy ultraviolet radiation ionizes the hydrogen atoms releasing accelerated, high kinetic energy subatomic protons and electrons. These subatomic ions collide with each other and convert or "thermalize" this high kinetic energy into infrared heat energy. Thus, the high energy ultraviolet radiation is converted to useful infrared heat energy. The amount of released hydrogen energy can be controlled by either (1) proportioning the amount of a composition of the invention added to the hydrocarbon fuel, or (2) regulating the rate of fuel feed or other operational parameters of the internal or external combustion engine to control the flame temperature at which the catalytic ingredient is activated. In this way, with the use of a composition of the invention, the reflected and measured efficiency of combustion of a hydrocarbon fuel can be increased dramatically by combining the non-oxidative released energy with ordinary oxidative combustion. These non-oxidative released energies are the result of the ionization of the hydrogen atom.

In addition, there are even higher levels of harnessable energy derived from the subatomic protons and electrons. When these ionized subatomic particles (plasmoids) produced by the ionization of hydrogen atoms come into close proximity, plasmoid fusion occurs. The resulting plasmoid energy is 1836 times as great as that produced by the ionization of a hydrogen atom alone. When the composition of the invention is added in a sufficient ratio to a hydrocarbon fuel in a highly elevated temperature environment, there is an exhibited collective behavior of the ionized protons and electrons. This collective behavior state occurs when said subatomic particles reach a density of 5% or higher. This collective behavior is called non-nuclear plasma fusion. The amount of energy released in this extremely high energy state is proportional to the level of fusion density.

Examples of the invention will be described below to illustrate the invention, and should not be construed as limiting its scope.

EXAMPLE 1

Preparation of Catalyst Composition #1

20% by weight of lithium stearate, 10% by weight of magnesium stearate, and 5% by weight of aluminum stearate (relative to the final composition) were placed in an autoclave which was filled with a helium gas. The autoclave was then heated to 425° F. to melt the metallic carboxylic acid salts. The pressure was kept at 5 atm throughout the preparation. After the salts were melted, the temperature was adjusted to 325° F. 57% by weight of mineral and organic oils and 8% by weight of silicon-based synthetic oils (relative to the final composition) were added to the molten salts and the mixture was kept at this temperature for 3 hours. The blend was then subjected to 5 cycles of heat treatments between 100° and 360° F. in a period of 2 hours. Finally, the blend was cooled to room temperature.

EXAMPLE 2

Preparation of Catalyst Composition #2

Catalyst #2 of the invention was prepared by repeating Example 1 except that the amounts of lithium, magnesium and aluminum stearates, and vehicle oils used were 16%, 8%, 4%, and 72% by weight, respectively.

EXAMPLE 3

Preparation of Catalyst Composition #3

Catalyst #3 of the invention was prepared by repeating Example 1 except that the amounts of lithium, magnesium and aluminum stearates, and vehicle oils used were 12%, 6%, 3%, and 79% by weight, respectively.

EXAMPLE 4

Preparation of Catalyst Composition #4

Catalyst #4 of the invention was prepared by repeating Example 1 except that only lithium stearate and a mineral oil were used, in amounts of 25% and 75% by weight, respectively.

EXAMPLE 5

Operation of Internal Combustion Gasoline Engine

A Ford car having a 302-CID, 4-cycle engine was used to make road tests of 10 round trips between Tappan Zee Bridge, NY, and Windsor Locks, CT, a distance of about 120 miles. The on-board instruments were calibrated to give maximum absolute errors of 0.001 mile and 0.001 gallon, respectively. Unleaded gasoline was used throughout the tests.

The first 5 round trips were made without using any catalyst of the invention. The resulting average fuel consumption was 8.28 gallons per 120 miles or 14.5 miles per gallon.

The second 5 round trips were made by adding Catalyst #1 of the invention to the gasoline fuel in the catalyst-fuel ratio of 1:1000 by weight. Since the air-fuel ratio necessary for the optimal catalyzed fuel operation is lower than that of the straight fuel operation because of the physical hydrogen reaction occurring with the aid of the catalyst of the invention, the air-fuel ratio in the catalyzed fuel operation was reduced so that the chemical combustion conditions might be kept equal in both types of operation.

The resulting average fuel consumption was 6.3 gallons for 120 miles or 19.0 miles per gallon. This figure is 31% higher than that of the above base line operation.

EXAMPLE 6

Operation of Internal Combustion Gasoline Engine

Example 5 was repeated except that the catalyst used and the catalyst fuel-ratio were Catalyst #4 and 1:2560, respectively.

The resultant fuel consumptions were 6.5 gallons for 120 miles or 18.6 miles/gallon for the catalyzed fuel operation, which is 28.6% higher than the 14.5 miles/gallon for the straight fuel operation.

EXAMPLE 7

Operation of Internal Combustion Diesel Engine

Example 5 was repeated except that the test vehicle, the fuel, the catalyst and the catalyst-fuel ratio were a Volkswagen Rabbit Diesel having a 1.5-liter diesel engine, an aviation fuel "A" (cetane rating #50), Catalyst #2, and 1:1250, respectively.

The resultant fuel consumptions were 2.7 gallons for 120 miles or 45 miles/gallon for straight fuel operation and 2.1 gallons per 120 miles or 57 miles/gallon for the catalyzed fuel operation, which is 27% higher than that of the straight fuel operation.

EXAMPLE 8

Operation of Internal Combustion Diesel Engine

Example 5 was repeated except that the test vehicle, the fuel, the catalyst and the catalyst-fuel ratio were a GM Oldsmobile having a 350-CID diesel engine, a diesel fuel (cetane rating #40), Catalyst #2, and 1:1500, respectively.

The resultant fuel consumptions were 5.8 gallons for 120 miles or 20 miles/gallon for straight fuel operation and 4.7 gallons per 120 miles or 25 miles/gallon for the catalyzed fuel operation, which is 25% higher than that of the straight fuel operation.

EXAMPLE 9

Operation of Internal Combustion Diesel Engine

A 40-ton trailer truck operated on diesel fuel was used to make road tests of two round trips of 1000 miles each. The first round trip was made using only diesel fuel having a cetane number of 40. The first half of the first round trip (500 miles) was run with a full load of 40 tons, while the return trip was performed with a half load. The second round trip was made in the same fashion using the same type of diesel fuel but mixed with Catalyst #2 of the invention at a catalyst-fuel ratio of 1:1500.

The resulting percent fuel savings for the operations with full and half loads were 22% and 17%, respectively.

The percent fuel saving was calculated as $$100\times(G_1-G_2)/G_1$$

where $G_1$ and $G_2$ are gallons of fuel used in the straight and catalyzed operations, respectively.

EXAMPLE 10

Operation of External Combustion Boiler

A boiler made by the Combustion Engineering Co. was used to conduct a series of tests. The boiler efficiency was defined as:

$$\text{Boiler efficiency } (\%)=100\times S(Es-Efw)/(F\times H)$$

where S is the quantity of steam generated per hour, Es and Efw are the steam and feed water enthalpies, respectively, F is the quantity of fuel oil burned per hour, and H is the quantity of heat per gallon of the oil.

The boiler first was operated using #6 Fuel Oil without adding any catalyst of the invention. The average readings taken for various quantities during the operation were as follows:

Rate of steam generated: 22,000 lbs/hr
Steam temperature: 500° F.
F.W. temperature: 186° F.
Steam pressure: 175 psi
Heat rate of the oil: 145,000 BTU/gal $$\text{Boiler efficiency (\%)}=100\times 22{,}000(1270-154)/(249\times 145{,}000)=68$$

Next, Catalyst #3 of the invention was injected into the burner manifold of the boiler at a catalyst-fuel rate of 1:2500, with the burner manifold recirculating valve closed. The rates of steam generated at 3 different rates of oil used were measured as shown in Table 1

TABLE 1

| Level | Oil consumed | Steam generated | Flame temperature |
|---|---|---|---|
| 1 | 185 gal/hr | 19,700 lbs/hr | 2100° F. |
| 2 | 205 gal/hr | 23,300 lbs/hr | 2300° F. |
| 3 | 260 gal/hr | 30,400 lbs/hr | 2700° F. |

The boiler efficiency at each level was calculated as:

$$B.E.1=100\times 19{,}700(1270-154)/(185\times 145{,}000)=82\ (\%)$$

$$B.E.2=100\times 23{,}300(1270-154)/(205\times 145{,}000)87\ (\%)$$

$$B.E.3=100\times 30{,}400(1270-154)/(260\times 145{,}000)=90\ (\%)$$

From the above results it is apparent that the use of the catalyst of the invention made the boiler efficiency at each operational level 20%, 28%, and 32% higher than that of the base line operation. It is noted that the boiler was run at the third operational level for only a short period of time because it was loaded above normal operating level. Unfortunately, the boiler was incapable of achieving and maintaining flame temperatures of over 2800°. The above results, however, showed that as the flame temperature increased from about 2100° to 2700° F., the boiler efficiency increased from 68% to 90%, indicating that the catalyst of the invention became more active at higher temperatures.

In both types of operations, a Hamilton 4-gas analyzer was installed to measure the quantities of oxygen, carbon dioxide, carbon monoxide, and unburned hydrocarbons in the stack gas. This gas analysis showed that the excess oxygen level in the catalyzed operation was only 1.5% to 2.5% in contrast to approximately 6% in the straight operation. The content of water vapor in the stack gas was substantially decreased in the catalyzed operation. This substantial decrease in stack water vapor is explained as follows. The hydrogen atom is oxidized to form water vapor during the normal chemical process known as combustion. However, when the composition of the invention is added to a hydrocarbon fuel in the proper ratio and above a certain minimum temperature, the hydrogen atom ionizes and is no longer available in its native state to combine with oxygen to form water vapor. In addition, a fireside inspection revealed that the hard deposits built up on the inaccessible areas below the steam drum over years had gone. What was left in the other areas was also easily washed away with running water from a hose.

EXAMPLE 11

Torque Test with Internal Combustion Engine

A 327-CID Chevrolet engine with four barrel carburetor was installed on a dynamometer. First, six power pulls were made at around the factory specification point without using any catalyst of the invention. The measured torques are shown in Table 2.

TABLE 2

| Pull | RPM | Torque | Corrected HP |
|---|---|---|---|
| 1 | 4250 | 240 | 196 |
| 2 | 4000 | 265 | 204 |
| 3 | 4400 | 250 | 211 |
| 4 | 5000 | 196 | 187 |
| 5 | 4500 | 235 | 203 |
| 6 | 5300 | 170 | 177 |

The correction factor was 1.028 based on a dry bulb reading of 104° F., a wet bulb reading of 76° F., and a barometric reading of 30.54. During the test, the water temperature of the engine remained at 190° F., the oil temperature, read at one of the external filters, was also 190°, and the oil pressure was 50 psi.

Then, the engine was brought to an idle, and one pint of Catalyst #1 of the present invention was put into 20 gallons of gasoline in the tank. The engine was idled for five minutes to prime it with the catalyst, then 16 pulls were made. (The reason so many pulls made here is that the test operators were at first incredulous about the results, and every effort was made to find accurate figures.) A correction factor of 1.033 was used based on a dry bulb reading of 108° F., a wet bulb reading of 76° F., and a barometric reading of 30.55. The readings of torque are shown in Table 3.

TABLE 3

| Pull | RPM | Torque | Corrected HP |
|---|---|---|---|
| 1 | 4600 | 237 | 210 |
| 2 | 4600 | 248 | 224 |
| 3 | 4200 | 270 | 223 |
| 4 | 4100 | 280 | 226 |
| 5 | 4000 | 275 | 217 |
| 6 | 4600 | 250 | 226 |
| 7 | 4650 | 242 | 221 |
| 8 | 4000 | 275 | 217 |
| 9 | 4400 | 255 | 222 |
| 10 | 4600 | 243 | 221 |
| 11 | 4800 | 238 | 226 |
| 12 | 4050 | 278 | 222 |
| 13 | 4400 | 264 | 229 |
| 14 | 4800 | 237 | 225 |
| 15 | 4500 | 246 | 219 |
| 16 | 4700 | 239 | 222 |

During the test, the water and lubricating oil temperatures were maintained at 190° F. The above data from Tables 2 and 3 can be combine to form Table 4 below.

From Table 4, it is evident that the average horsepower in the catalyzed operation is 10.0% to 27.5% higher (over the same range of operation) than without the composition of the invention being present in the fuel. FIG. 1 is a graph illustrating the above results more clearly.

TABLE 4

| Engine RPM | HP Differential | % Gain |
|---|---|---|
| 3000 | 36 | 27.5 |
| 3500 | 25 | 15.0 |
| 4000 | 21 | 11.0 |
| 4500 | 20 | 10.0 |
| 5000 | 43 | 23.0 |
| 5500 | 39 | 22.0 |

While the specific examples of the invention have been described above, it is understood that various modifications or substitutions may be made in the above specific examples and therefore it is our intention that all such equivalents fall within the scope of the invention as recited in the following claims.

What is claimed is:

1. A composition of matter for harnessing the hydrogen energy of a hydrocarbon fuel, which comprises:

10% to 90% by weight of a liposoluble organometallic salt of a fatty acid; and

90% to 10% by weight of a vehicle oil, said organometallic salt being an organometallic lithium salt.

2. A composition of matter as recited in claim 1, wherein said liposoluble organometallic salt consists of 7% to 60% by weight of an organometallic lithum salt and 3% to 30% by weight of an organometallic magnesium salt.

3. A composition of matter as recited in claim 1, wherein said liposoluble organometallic salt consists of 6% to 50% by weight of an organometallic lithium salt, 3% to 30% by weight of an organometallic aluminum salt.

4. A composition of matter as recited in claim 1, wherein said vehicle oil contains 0.1% to 12% by weight of a peroxide oxidant.

5. A process for preparing a hydrogen energy harnessing composition, which comprises the steps of:

heating 10% to 90% by weight of an organometallic salt to temperatures between 50° and 800° F. under pressures between one and 30 atm, for melting it;

adjusting said temperature to between 250° and 500°;

adding 90% to 10% by weight of a diluent oil to said organometallic compound to form a solution;

keeping said solution at the same temperature for a period of from 5 minutes to 12 hours; and letting said solution stand to cool to room temperature.

6. A method of harnessing the hydrogen energy of a hydrocarbon fuel, which comprises the step of adding a catalyst composition comprising 10% to 90% by weight of a liposoluble organometallic lithium salt of a fatty acid and 90% to 10% of a vehicle oil to a fuel so that the percent of catalyst to fuel may be in the range of from 0.0001% to 10% by weight.

* * * * *